United States Patent [19]

Kankaanpaa

[11] 4,285,766

[45] Aug. 25, 1981

[54] PRESS METHOD IN A PAPER MACHINE

[75] Inventor: Matti Kankaanpaa, Espoo, Finland

[73] Assignee: Valmet OY, Finland

[21] Appl. No.: 82,063

[22] Filed: Oct. 5, 1979

Related U.S. Application Data

[60] Continuation-in-part of Ser. No. 790,209, Apr. 25, 1977, Division of Ser. No. 310,805, Nov. 30, 1972, abandoned.

[51] Int. Cl.[3] ..... D21F 1/32

[52] U.S. Cl. ..... 162/199; 162/205; 162/30 S; 162/360 R

[58] Field of Search ..... 162/191, 205, 264, 305, 162/306, 358, 360 R, 199; 100/121, 158, 163, 170, 176

[56] References Cited

U.S. PATENT DOCUMENTS

| | | | |
|---|---|---|---|
| 2,764,068 | 9/1956 | Sutherest | 162/264 |
| 3,861,996 | 1/1975 | Dorfel | 162/360 |
| 4,075,056 | 2/1978 | Ely et al. | 162/305 |

FOREIGN PATENT DOCUMENTS 0551522 1/1958 Canada .

*Primary Examiner*—Peter Chin

*Attorney, Agent, or Firm*—Steinberg & Raskin

[57] ABSTRACT

A method in a paper machine press section for dewatering a wet paper web by threading the web in an improved way and avoiding crushing or stretching the web structure through at least three nips of the press section. The invention is particularly characterized by following features of dewatering steps. The web while passing the press section through said three nips is all the time adhered to and supported by the surface of a felt or a roll without any open draws therebetween. Pressing the web in the first nip takes place between two felts and so the web is dewatered simultaneously through both sides of the web. Further dewatering and pressing steps take place in press nips which all are formed against a plain roll having a large diameter which enables a spacious location of the press rolls and their felts. Detaching the web from the surface of said plain roll for conducting the web into dryer section, takes place in a point allowing easy removal and handling in case of a web break.

20 Claims, 2 Drawing Figures

PRESS METHOD IN A PAPER MACHINE

CROSS REFERENCE TO RELATED APPLICATIONS

This application is a continuation-in-part of application Ser. No. 790,209 filed Apr. 25, 1977 which is a division of Application Ser. No. 310,805 filed Nov. 30, 1972 abandoned.

BACKGROUND OF THE INVENTION

The present invention concerns a method for dewatering a paper web which is conducted through a multi-roller press assembly comprising at least three consecutive press nips defined by rollls interacting with each other and through which nips the continuous paper web coming from the wire passes, being continually supported between the nips.

The present invention further relates generally to an improved method in a paper machine press section for dewatering a paper web efficiently yet gently so that the paper produced obtains advantageous structural and strength properties. In this connection particular attention is directed to the pressing procedure in the first press nip wherein the run of the press felts has been arranged and the press rolls selected with a view towards achieving a very high effectiveness in the dewatering while simultaneously providing a symmetrical dewatering and thus also a symmetrical sheet structure.

It is well known that in conventional pressing methods, as much water as possible is attempted to be removed from the paper web mechanically, whereupon the paper web is conducted into the drying section of the machine, where the rest of the water is removed from the paper web by evaporation. The most important and most serious problem in dewatering a web by pressing it between press rolls is that if one tries to remove water too efficiently and too rapidly, the fibre network in the paper web is not preserved well enough intact. In that case the natural strength of the web suffers, which has a negative effect both on the running of the paper machine and on the quality and other characteristics of the completed paper. In conventional paper machine press sections, the web is carried by a felt and is conducted into a pressing nip formed by two rolls. In such a nip the dewatering takes place due to the pressure applied to the web between these rolls. Conventionally, one roll has a plain surface facing the web whereas the other roll which is typically wrapped by said press felt usually has a recessed surface of some kind. In earlier low speed paper machines, two such dewatering press nips are provided, each nip being formed by a pair of rolls as described above.

The amount of water removed by such pressing is proportional to the pressure applied and also to the dwell time of the web in the press nip, i.e., to the time during which the web is under pressure. In high-speed paper machines where the web is conducted rapidly through the press nips, the pressing time becomes relatively short. To make the total time during which the web is subjected to the pressing treatment sufficiently long to achieve adequate dewatering, there must be several nips in the press section. Of course, the broader the nip is, the longer is the pressing time. A thick and soft press felt used between press rolls broadens the nip width.

In pressing methods of conventional press assemblies of the prior art, it also easily happens that, owing to conventional dewatering methods, the structural symmetry of the paper web cannot be preserved, which has a detrimental effect on the quality of the produced paper. The dewatering taking place in the first press nip of the press assembly has a decisive effect as regards the characteristics of the paper that is manufactured. Prior to entry into the press treatment, the paper web contains water in an amount equal to about 4 to 6 times the amount of fibres found in it. However, the water content depends to a great extent on the speed of the paper machine. Thus, at very high speeds, the amount of water in the web leaving the wire section may be 9 to 10 times the fibre content. In the first press nip, the water is removed relatively easily even by a relatively slight pressure. However, special arrangements as regards press roll types and press felts are required. When the web, containing a relatively great amount of water, is pressed, part of the fibres in the web tend to move along with the escaping water, thus suffering a displacement. The original fibre and material distribution in the paper web may even substantially change if dewatering in the press nip takes place in one direction only, through one face of the paper web. This is in fact what occurs in conventional press nips, where one surface of the paper web is opposed by a smooth roll surface and the other surface is towards a felt, under which there is e.g., a foraminous or groove roll surface.

SUMMARY OF THE INVENTION

The present invention aims at improvement as regards the problems of paper manufacture introduced by the dewatering process as well as at developing a pressing method with a view to improving the efficiency of the operation of the paper machine. The starting point consisted of the consideration that, although dewatering is efficiently accomplished, the fibre network of the paper web should remain intact and structurally symmetrical. The passage of the paper web through the press assembly should be accomplished without subjecting the paper web to unnecessary stretch or other stress.

One of the characteristic features of the invention is that the paper web has been arranged to pass through the first press nip enclosed between two felts and that both rolls used to define this press nip are water receiving rolls or rolls which efficiently remove water. The concept of a "roll efficiently removing water" or a "water receiving roll" is here understood to be a general name for such rolls which have on their surface suitable cavities, holes or grooves, which promote the escape of water expressed from the paper web at the press nip. The commonest roll appropriate for this purpose is the foraminous suction roll and which has been connected to a vacuum system. Anothe type of recessed surface roll is a grooved surface roll. The cavities on the roll shell may also be so-called blind drilled holes. The most recent development in such rolls with surfaces having cavities is represented by a roll type coated with a special coating, as disclosed in the U.S. Pat. No. 3,718,959, in which roll type, owing to the particular manufacturing process, the cross sectional shape of its groove-like cavities may be chosen almost arbitrarily and the volume of the grooves can be made greater than conventional grooved rolls having grooves of the same width. The greater the volume of the cavities, the greater is the amount and efficiency with which water can be expressed from the paper web in the respective press nip.

The felts utilized in the dewatering in the first nip generally have a weight on the order of 1000–1100 grams per sq. meter. The particular weight of course depends on the raw material of which the felts are constructed. Also the nature of the web to be pressed is of importance.

The extent to which a web is dewatered in such a double felted nip depends on certain additional factors. The use of a pair of felts at the nip results in a broader nip, i.e., a nip having a greater area of contact between the felts and the web, than in a conventional single felted nip equipped with a felt of the same type and quality. A broader nip implies a longer time interval during which the web is pressed in the nip and consequently, increased dewatering. Further, a broad nip results in a relatively gentle pressing of the web whereby the sheet structure is maintained intact and the danger of inadvertent web crushing is eliminated, despite the fact that relatively high loads are employed. Dewatering is increased in a double felted nip for the additional reason that since water is expressed from the web simultaneously in two directions as discussed below, only about one-half of the total amount of water is removed through a single felt, thereby resulting in a decreased flow resistance through each felt.

Effective dewatering in the press nip improves cumulatively the performance of the entire press section according to the invention. The higher is the dryness of the paper web when coming into the second nip, the less water is to be handled therein and to be removed from the web. Further, the drier the web is when entering the second nip, the higher pressing load and pressure it tolerates without becoming crushed. These factors make the pressing procedure according to the present invention much more effective than in a conventional press assembly.

Similarly the dewatering in the third press nip is improved resulting in very high final dry content of the web leaving the press section. The dryness obtainable by pressing depends to a great extent on the fibre type used for the paper produced and on the wet web properties. The present method and arrangement allows optimizing the press loads applied in each particular case and in each nip for achieving the highest dry content possible without damaging the wet web.

Considering that the dewatering by evaporation in the paper machine drying section is up to 10 times more expensive than water removal by mechanical pressing, it is evident that the present method greatly reduces the steam consumption of the paper machine and thus the direct production costs.

When a roll efficiently removing water of any type of the kind described, is disposed on both sides of the press nip, such an arrangement means in principle that dewatering takes place through both surfaces of the paper simultaneously and symmetrically. When the web passes horizontally through the press nip, gravity tends to produce the effect that a greater part of the water expressed from the paper web may escape through the lower felt, compared to that removed through the upper felt. This can be prevented by selecting for the lower felt a felt type of greater density or heavier weight, i.e., lower water permeability than for the upper felt. It is also possible to provide in the press nip in question a lower roll having a more closed surface structure than the upper roll or which is of another type. Thus, it is most appropriate for the upper roll to be a suction roll. If a suction roll is used in the upper roll position in the first nip the upper felt can be heavier than the lower felt or both can have same weight, since the vacuum in the suction roll can counteract the gravity effect. By this means the desired symmetric dewatering is ensured, which is important in view of preserving the structural symmetry of the paper web.

As the extent of water removal in a nip of above type depends in part on the openness of the roll surface and in part on the permeability of the press felt, the symmetry of the dewatering can be controlled by selecting proper roll and felt combinations. Of course, it is much easier to change the felts than the rolls. Therefore, it is preferable to initially provide the lower rolls with a relatively closed surface, for example, where the open area of the cavities (grooves or holes) is about 12% to 18% of the total surface area whereas the open area of the upper roll may be about 14–20%. The desired control of the dewatering in both directions is then achieved by selecting proper felts for upper and lower position, e.g., the upper felt may have greater density than the lower felt.

Especially in high-speed paper machines, the press assembly is required to have several press nips in order to achieve the highest possible efficiency of total dewatering in the press section. However, it is not necessary to have double sided dewatering in all nips. After dewatering has been accomplished in the first press nip symmetrically under the conditions described above, the structure of the paper has usually already been consolidated sufficiently to enable, as a rule, the dewatering in subsequent press nips to take place unilaterally without risk of any detrimental changes in the fibre distribution and structure of the paper web. Of course, this depends on the composition of the paper web and on the characteristics and dimensions of its fibres. A web having a highly homogeneous composition and which contains a great amount of long fibres and virtually no fillers, permits dewatering in one direction only in subsequent steps.

When the aim is to design a press assembly and to develop a pressing method having the characteristics of highest possible compactness, small space requirements and best performance as regards the reliability in operation of the paper machine, the path of the paper web through the press assembly should be designed so that the paper web proceeds between consecutive press nips supported either by press felts or by press rolls as far as possible. In a press assembly designed for applying the method in accordance with the present invention it is in fact possible, in addition to the improvements relating to the paper properties, to achieve such a closed threading or conduction, i.e., no-draw conduction, of the web through the press nips which is highly advantageous in view of the runnability of the paper machine and which improves the running efficiency of the machine. In this case it is not always possible in the press nips following after the first one to apply the symmetric dewatering principle; instead, these press nips have to be designed for unilateral dewatering. But, as has been said, this solution is not objectionable except in the case of a very few paper grades.

It is always necessary in the pressing process in a paper machine to have a periodic step of rethreading the web through the press section at machine start-ups after a shut-down. This web threading can be carried out in an improved way according to the present invention. In this connection it is to be noted that the present invention offers also an improved method for handling and leading away the web broke which unavoidably is formed during start-ups of paper machine. The broke removal most conveniently takes place after the press section at the open draw where the web is conducted to the dryer section.

As noted above, the amount of water which is removed from the web in a nip depends on one hand on such factors as paper machine speed, felt type or quality, and nip pressure, on the other hand on factors related to the particular properties of the web, such as web thickness, water content of the web when entering the nip and fibre composition of the web.

Table 1 illustrates the dewatering capacity of the present pressing method invention under various operating conditions.

TABLE

| | | | | | | | | | | | | |
|---|---|---|---|---|---|---|---|---|---|---|---|---|
| Web speed, m/min | 810 | | 810 | | 900 | | 900 | | 900 | | 1200 | |
| Web consistency, % when leaving wire part | 12,4 | | 15,2 | | 10,5 | | 15,0 | | 15,4 | | 10,1 | |
| Furnish type | A | | B | | A | | B | | C | | A | |
| Dewatering by pressing | $Q_A$ | $Q_R$ | $Q_A$ | $Q_R$ | $Q_A$ | $Q_R$ | $Q_A$ | $Q_R$ | $Q_A$ | $Q_R$ | $Q_A$ | $Q_R$ |
| in 1st nip | 116,7 | 70,8 | 88,9 | 69,7 | 159,3 | 76,8 | 96,3 | 70,8 | 96,4 | 68,6 | 242,4 | 79,2 |
| 2nd nip | 24,9 | 15,1 | 20,3 | 15,9 | 28,6 | 13,8 | 21,3 | 15,7 | 25,9 | 18,4 | 40,4 | 13,2 |
| 3rd nip | 23,3 | 14,1 | 18,4 | 14,4 | 19,6 | 9,4 | 18,3 | 13,5 | 18,3 | 13,0 | 23,3 | 7,6 |
| Total | 164,9 | | 127,6 | | 207,5 | | 135,9 | | 140,6 | | 306,1 | |
| Web dryness, % when leaving press section | 41,8 | | 41,8 | | 32,3 | | 39,5 | | 41,5 | | 30,3 | |

$Q_A$ refers to dewatering in liters per minute per one meter web width

The noted results are based on trial runs on a pilot plant paper machine with a working width of one meter while all the other relevant dimensions, such as wire length and roll diameters, are of the same order as in a conventional paper mill unit. The paper grade produced was newsprint having a basis weight of 39–42 g/m$^2$.

The nip pressures used in this series of experiments are 1st nip=60 kP/cm (kiloponds per centimeter); 2nd nip=75 kP/cm; 3rd nip=90 kP/cm.

The values listed under $Q_A$ constitute the extent of dewatering in liters per minute in each indicated nip whereas the values listed under $Q_R$ refer to relative dewatering or distribution of dewatered amounts in the successive press nips indicated as a percent of the total amount.

In addition to the above-mentioned characteristic concerning the most important first dewatering step, it is a characteristic feature of the invention in view of improved reliability in operation of the press assembly that for the purpose of forming the following press nips after the first press nip the press assembly comprises a roll with plain smooth surface provided with a doctor means, which roll usually has a diameter substantially, at least 10 percent, greater than the larger of the rolls defining the first nip and which smooth surfaced roll is urged against the upper roll of the two rolls belonging to the first nip so that thus the second press nip of the press assembly is formed at a point at a distance equivalent to an arc of 90 to 150 degrees from the first nip, this arc distance being measured along the periphery of said efficiently dewatering upper roll. With respect to this distance between the first nip and the second nip, it is noted that according to the preferred embodiment for applying the method of the present invention, the centers of the rolls which define the first nip, are located substantially vertically relative to each other. The arcuate distance relates to this mutual position of said rolls.

This relative positioning of the plain roll with respect to the upper roll a defined by this central angle results in the plain roll being advantageously positioned as regards broke removal of a full wide web to which reference has been made above.

The large diameter of the smooth surfaced roll enables additional press nips to be formed in the press assembly, for the purpose of boosting its action, after said second nip so that between each two of these nips the paper web proceeds through the press assembly, being supported by the surface of said smooth roll all the time. The large diameter of said plain roll allows also a proper position for the doctor means to enable an easy removal of the broke into the broke put just beneath the plain roll.

The third nip of the system is accomplished by urging a third efficiently dewatering roll, disposed within a felt loop of its own, against said smooth surfaced roll at a point at 70 to 160 degrees arc distance from the second nip, measured along the periphery of the smooth surfaced roll.

It is furthermore possible to provide in the press assembly also a fourth press nip at a point having a distance of about 70 to 160 degrees from the third nip, again measured along the periphery of the smooth surfaced roll.

When determining the diameter of this plain smooth-surfaced, center press roll, the following factors are important: the number of nips required to be formed against this roll and whether all of these nips are dewatering nips. Furthermore, the diameters of the additional dewatering rolls belonging to said nips must be taken into account, which diameters are also dependent on the width of the machine. More particularly, the wider the machine, the larger, in general, is the diameter of the dewatering rolls and also of the felt leading rolls. Further, in determining the diameter of the center plain roll the fact that a free space must be arranged under that roll which is sufficiently large to allow removal of the broke must be taken into account. Also the ability to change felts must be taken into account.

The mutual distances of the press nips are in part dependent on the framework of the press assembly and in part on other factors which are explained above. The large diameter smooth-surfaced roll, which is the mating roll in the second, third and fourth nips, can be carried on a lever arm having its pivotal point in the frame portion over said roll, so that the lever arm is oriented with reference to the vertical most usually at an angle of 25 to 40 degrees in the direction of the entering or leaving paper web. When the lever arm has an inclined position pointing towards the direction of the emerging paper web, the second and third nips have to be spaced far apart, corresponding to about 120 to 160 degrees or arc, while the distance between the third and fourth nip is about 70 to 120 degrees in this case. If in turn, the lever arm is inclined, pointing in the direction of the leaving paper web, the corresponding arc distances may be:

between the second and third nips 70 to 120 degrees, between the third and fourth nips 120 to 160 degrees, As further regards the fourth nip, it is possible to place at this point, depending on the paper grade to be manufactured and on the running conditions of the paper machine, either a further smooth roll or a fourth efficiently dewatering roll. If it is desired that the fourth nip acts only as a so-called equalizing or smoothing press, a smooth roll without felt is used. If, on the other hand, it is necessary still to proceed with the dewatering at this stage, an efficiently dewatering roll is employed, which operates within a felt loop of its own.

The invention as described in greater detail in the following with reference to the attached schematic principle drawing, in which a couple of embodiment examples of the invention are presented.

As the invention refers to a method in a paper machine of dewatering the web through pressing, the press section in question is only partly shown. The frame structure of the press section is omitted for clarity. Also some devices conventionally belonging to a press section and which are obvious to those skilled in the art, such as felt stretchers, felt guiding devices and felt conditioners, and which may be of any common construction, are not shown.

Figure 1:
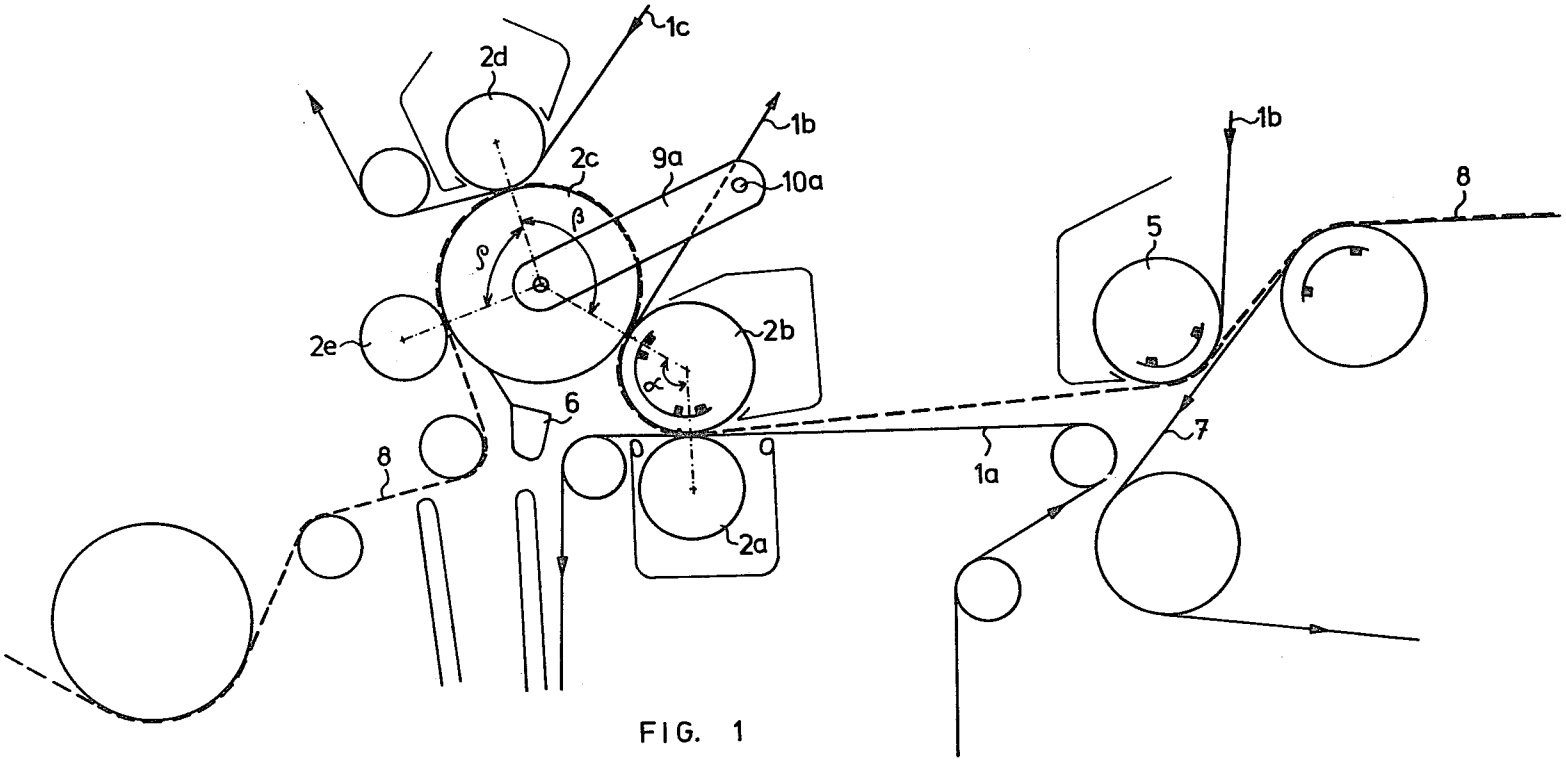
FIG. 1 shows schematically, in elevational view, a paper machine press assembly in which the method according to the invention is applied.

In the embodiment of FIG. 1, the paper web 8 is detached from the wire 7 by the aid of a pick-up suction roll 5, whereby the paper web 8 is transferred in so-called closed run onto the first felt 1*b* passing over the roll 5 and arrives, adhered to this first felt without any support from below, at the first press nip, which is defined by a first roll 2*b* and a second roll 2*a*. A second felt 1*a* also passed through this press nip 2*a*/2*b* whereby the paper web travels through the nip enclosed between two felts. The first felt and the second felt do not have a common run substantially before the first nip so as to counteract any blowing effect. The rolls 2*a* and 2*b* are both efficiently dewatering rolls having cavities in their surfaces. Roll 2*b* is preferably a suction roll, 2*a* a water receiving roll, preferably a grooved roll. The open surface of roll 2*a* is about 12–20 percent. The open surface of suction roll 2*b* is about 14–20 percent. Preferably, the open surface area of the lower water receiving roll 2*a* is about 1% less than the open surface area of the upper water receiving roll 2*b*. In this manner a symmetric 2-sided dewatering of the web in the first press nip can be achieved.

Further, a symmetric 2-sided dewatering of the web in the first press nip can be achieved by using as the lower felt a fabric having a greater density, i.e., having a lower water permeability, than the upper felt.

The dewatering of the web takes place in this first press nip by pressing, the pressing force being in the range of about 50–80 kP/cm. The most common range is 60–70 kP/cm and in the particular case of the pilot or experimental machine running newsprint type sheet (40 g/m$^2$), a line pressure of 60 kP/cm proved satisfactory. Since the web is enclosed between two felts and as the press rolls have recessed surfaces the dewatering takes place in two directions through both sides of the web.

After the first press nip and after pressing has ceased, the paper web 8 is detached from felt 1*a* by the suction of suction roll 2*b* and travels in a closed run, that is attached by suction to the felt 1*b* to the second press nip 2*b*/2*c*. After the first nip the felt loop 1*a* is threaded downwardly and during its travel is conducted through conventional paper felt conditioning means for improving its water absorbing capacity. Thus, the felt 1*b* wraps the suction roll 2*b* and the web follows felt 1*b*. The web is thus transferred to the second nip 2*b*/2*c* while adhered to the felt surface and subject to the suction from roll 2*b*. The center angle corresponding to the suction sector of suction roll 2*b* is designated $\alpha$. The suction prevailing in the suction sector has two effects: suction prevents detaching of the web from the felt surface in spite of the centrifugal forces exerted on the web. The suction also provides that the water which is removed in the nip from the web and which is absorbed by the felt 1*b* remains in the felt structure after the nip, thereby preventing rewetting of the web (so-called rewetting phenomenon).

Referring to the second nip 2*b*/2*c*, the roll 2*c* is a smooth-surfaced plain roll and is preferably formed of granite or an equivalent artificial material and has a substantially larger diameter than the suction roll 2*b* for the reasons described above. Depending on the grade of the paper, in the second nip 2*b*/ 2*c*, pressing of the web is accomplished at an appreciably higher pressure than in the first nip, namely in the range of between about 60–90 kP/cm. For example, in the case of newsprint, a proper range is 70–80 kP/cm and in the pilot machine a line pressure of 75 kP/cm was successfully applied. This relatively higher pressure is possible since the majority of the water has already been removed in the first press nip and, therefore, there is no risk of crushing the web in the second nip. At the press nip 2*c*/2*b* dewatering takes place in one direction only, namely, through the upper surface of the paper web, i.e., in the direction toward the suction roll 2*b* and felt 1*b*. From the second press nip, the paper web adheres to the surface of plain roll 2*c* by adhesion forces and is transferred on the surface of the roll 2*c* to the third press nip 2*c*/2*d*. The felt 1*b* is detached from the web after the second nip 2*b*/2*c* and is guided by conventional felt guiding rolls (not shown) through appropriate conventional felt conditioning means. The third nip is formed by the plain roll 2*c* and an efficiently dewatering recessed surface roll 2*d*. The recessed surface roll 2*d* is located within its own felt loop 1*c*. The distance between the second nip 2*b*/2*c* and the third nip 2*c*/2*d* in terms of the corresponding center angle of the plain press roll 2*c* is designated $\beta$. In the third nip 2*c*/2*d*, like in the second nip 2*b*/2*c*, dewatering takes place only in one direction, i.e., through the upper surface of the paper facing the third felt. However, this does not disturb the structural symmetry of the web since at this point, the web is already sufficiently solidified.

Therefore, it is possible in most cases to use in the third nip a very high pressing force, generally up to about 120 kP/cm, without crushing the web. Factors which may limit the maximum, in addition to the quality of the web itself, include the mechanical strength of the press rolls in this nip and the felt quality used. One typical pressure range is about 80–110 kP/cm and again referring to the trial runs on the pilot machine, a pressure of 90 kP/cm was found satisfactory.

The angle indicated by $\alpha$ in the drawing is within the range of about 90° to 150° and that marked $\beta$ is between about 70° and 160°.

From the third press nip the paper web travels forwardly still adhered to the surface of the plain roll 2c from which the web can be detached in a conventional manner as an open draw, whereupon the web can be threaded to the dryer section. However, in the embodiment of FIG. 1, the press assembly furthermore comprises a roll 2e which, together with the roll 2c, defines a so-called smoothing or eqaulizing press nip which is located after the third dewatering nip 2c/2d. The roll 2e has no felt and may be disposed at an angular distance $\rho$ equal to about 70° to 160° from the third press nip 2c/2d.

As shown in FIG. 1, the plain press roll 2c is fitted with a doctor device 6 for keeping the roll surface clean during normal paper operation. In case of web breakage, this doctor 6 detaches the broke from the roll surface and drops it into the schematically illustrated broke pit 9 which is situated just underneath the plain roll.

Figure 2:
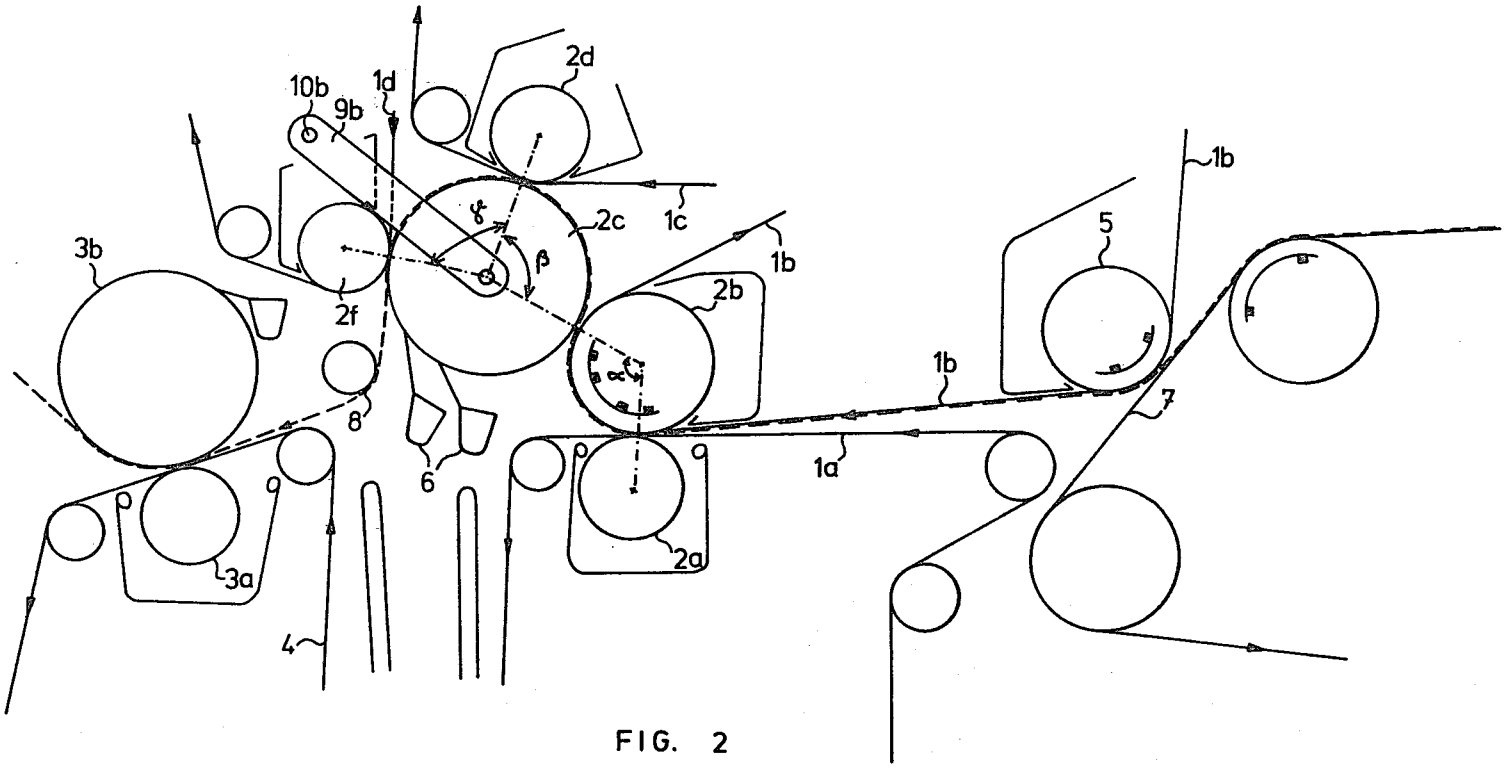
FIG. 2 shows schematically, in elevational view, another embodiment of a paper machine press assembly for applying the invention.

The embodiment of FIG. 2 is, up to the third press nip 2c/2d, substantially similar to that shown in FIG. 1. The angle $\beta$ which designates the arcuate distance between the second and the third nip is, however, in the embodiment of FIG. 2, smaller than that in FIG. 1. In this manner, it is possible in a design according to FIG. 2, to form against the roll 2c a fourth dewatering nip. In this connection it is noted that a water removing roll, such as roll 2f, which operates within a felt loop 1d of its own with the associated guiding rolls and water savealls, requires much more space than a smoothing roll, such as roll 2e, which furthermore usually has a smaller diameter than a dewatering press roll. Further, space must be provided for facilitating a felt change. Thus, instead of the smoothing roll 2e of FIG. 1, a fourth efficiently dewatering roll 2f is placed so as to be contiguous with the smooth surfaced roll 2c to define in the press arrangement the fourth press nip 2c/2f, having a distance from the third press nip 2c/2d of the press assembly equivalent with the arc designated by $\gamma$. The angle $\beta$ may be within the range of about 70°–160°. In the embodiment of FIG. 2, the plain roll 2c is provided with two doctor devices 6. One of these may be used where so-called wet creped paper is manufactured.

According to FIG. 2, the paper web 8 conducted, after the fourth press nip 2c/2f into the nip 3a/3b defined by the pair of rolls 3a, 3b. This pair of rolls comprises an efficiently dewatering roll 3a within a felt loop 4 of its own, and a smooth roll 3b. In the nip 3a/3b, dewatering takes place, with reference to the plane of the web 8, in a direction opposite to that in the fourth, third and second nips preceding this nip 3a/3b.

As regards, in practice, the designs of different efficiently dewatering, i.e., water receiving rolls and their various alternatives 2a, 2b, 2d and 2f, these rolls may be, for instance, of the following kinds:

The roll 2a may be a suction roll, but preferably is a simpler recessed surface roll (grooved roll, blind hole drilled roll, roll with plastic wire covering, etc.). If it comprises a recessed surface roll, it may be a flexible or a deflection-compensated roll, or a simple normal roll.

The roll 2b is preferably a suction roll provided with one or several suction zones, but a recessed surface roll in general may also be used. Thus, a grooved roll having an externally located suction chamber may be utilized.

For the rolls 2d and 2f similar structures can be considered as for roll 2a. Grooved rolls are most suitable.

Roll 2c as well as roll 2e may be rolls having a smooth and hard or soft surface.

As discussed above, the diameter of the plain center roll 2c is determined only on the basis of the space requirements, the strength properties having only a minor, if any, importance. On the other hand, the diameter of the suction roll 2b is decisively dependent on strength considerations. The suction roll must be stiff enough so that it will not bend under load and so that it does not become flattened. Usually, on wide machines, the suction roll is considerably smaller than the center plain roll. In relatively narrow machines, the center roll is about 10% larger than the suction roll.

The diameter of the lower roll 2a of the first dewatering nip depends on the width of the machine and also on the design and type of the roll. This roll is normally considerably smaller in diameter than the suction roll against which it operates.

It is thus understood that the invention is in no way narrowly confined to the embodiment examples presented in the foregoing. Various details in the design on a paper machine press assembly according to the invention may be altered, modified and combined in many different ways without departing from the idea of the invention. It should be realized that the arrangement of nips implied by the invention is achievable by a great number of different arrangements of rolls and felts.

What is claimed is:

1. A method in a paper machine press section for dewatering a wet paper or paperboard web by threading the web through at least three nips of the press section, the web being supported by the surface of a felt or a roll at all times, comprising the steps of:

detaching the web from the paper machine forming wire by means of a first felt loop and a pick-up roll operating within said first felt, and adhering the web onto the lower outer surface of said first felt loop by means of suction prevailing in the suction sector of said pick-up roll;

transferring the web which adheres to the lower surface of said first felt loop primarily by adhesion forces and without any substantial support from below to a first dewatering press nip of the press section which nip is formed by and between an upper foraminous suction roll and a second water receiving lower roll;

threading a second felt loop into the first dewatering press nip so that said second felt comes into contact with the web adhered on the first felt not until substantially in region of said first press nip;

pressing the web in the first dewatering press nip between the first felt and the second felt while applying between the press rolls a first linear pressure to dewater the web simultaneously in two directions through both sides of the web;

detaching the web from contacting the second felt by means of suction prevailing inside said upper suction roll;

treating the second felt after having left the first nip by felt conditioning means and threading it back to the first nip in said manner;

adhering the web by suction on the surface of the first felt wrapping said suction roll on a sector following the first nip, said sector corresponding to a central angle of 90 to 160 degress of the suction roll and so transferring the web to a second dewatering press nip formed by said suction press roll and by a smooth surface plain press roll;

pressing the web in said second nip using a second linear pressure so as to dewater the web through the one side facing the first felt;

detaching the web from the first felt utilizing the adhesion force of the surface of said plain press roll and adhering the web on last mentioned surface;

treating the first felt after having left the second nip by its felt conditioning means and threading the first felt back to wrap said pick-up roll;

transferring the web adhered on the surface of said plain press roll, to a third nip formed by said plain press roll and a fourth press roll which fourth roll is a water receiving roll so that the travel of the web while proceeding adhered to the plain roll surface from the second nip to the third nip corresponds to a central angle of 70–160 degrees of the plain roll;

threading a third felt into said third nip and pressing the web in said third dewatering press nip using a third linear pressure so as to dewater the web through its one side facing the third felt; and transferring the web, which beginning from the second nip, is continuously adhered to the surface of said plain press roll after said third nip, to a following web processing phase.

2. A method according to claim 1 wherein the first linear pressure in the first dewatering press nip is in a range of about 50–80 kP/cm.

3. A method according to claim 2 wherein the linear pressure is 60–70 kP/cm.

4. A method according to claim 1 wherein the second linear pressure applied in the second nip is in a range of about 60–90 kP/cm.

5. A method according to claim 4 wherein the second linear pressure applied in the second nip is in a range of about 70–80 kP/cm.

6. A method according to claim 1 wherein the third linear pressure applied in the third nip is in a range of about 70–120 kP/cm.

7. A method according to claim 6 wherein the third linear pressure applied in the third nip is in a range of about 90–100 kP/cm.

8. A method according to claim 1 wherein the amount of water dewatered from the web in the first dewatering nip is 65–85% of the total amount dewatered from the web in the press section.

9. A method according to claim 1 wherein the amount of water dewatered from the web in the second dewatering nip is 10–20 percent of the total amount dewatered from the web in the press section.

10. A method according to claim 1 wherein the amount of water dewatered from the web in the third nip is 5–15% of the total amount dewatered from the web in the press section.

11. A method according to claim 1 wherein the symmetry of the two-sided dewatering from the web is achieved in the first press nip by using as the lower water receiving roll a roll having less open surface structure than in the upper roll.

12. A method according to claim 11 where the symmetric dewatering in the first press nip is achieved by using as the lower roll a roll having a 12–18% open surface whereas the open surface of the upper roll is 14–20%.

13. A method according to claim 1 wherein the amount of water dewatered from the web in the first dewatering nip is at least about 70% of the total amount dewatered from the web in the press section.

14. A method according to claim 1 wherein the amount of water dewatered from the web in the first dewatering nip is 3–6 times the amount dewatered in the second dewatering nip.

15. A method according to claim 1 wherein a symmetric dewatering of the web and, therefore, a symmetric web structure, is obtained in the first press nip by performing a two-sided dewatering of the web in the first press nip and controlling said dewatering by selecting an appropriate density and/or weight for the upper and lower press felts in the first press nip.

16. A method according to claim 1 wherein the two-sided dewatering from the web in the first press nip is controlled at least in part by selecting an appropriate open surface area of the cavities in the upper and lower press rolls of the first press nip particularly for achieving a symmetric dewatering from the web in the first press nip and therefore a symmetric web structure.

17. A method according to claim 15 wherein the symmetry of the two-sided dewatering from the web in the first press nip is achieved by using as the lower press felt a fabric having a greater density, i.e., having a lower water permeability than the upper felt.

18. A method according to claim 16 wherein the symmetry of the two-sided dewatering from the web in the first press nip is achieved by using as the lower water receiving roll in the first press nip a roll having a less open surface structure than in the upper roll.

19. A method according to claim 16 wherein the symmetric dewatering in the first press nip is achieved by using as the lower roll a roll having a 12–20% open surface.

20. A method according to claim 18 wherein the symmetry of the two-sided dewatering from the web is achieved by using as the lower water receiving roll a roll in which the open surface area is at least about 1% less than that in the upper press roll.

* * * * *